US006168557B1

(12) United States Patent
Liao

(10) Patent No.: US 6,168,557 B1
(45) Date of Patent: Jan. 2, 2001

(54) COMPLEX EXERCISER STRUCTURE

(75) Inventor: Sarah Liao, Taipei (TW)

(73) Assignee: Sound Sports Co., Ltd., Taipei (TW)

( * ) Notice: Under 35 U.S.C. 154(b), the term of this patent shall be extended for 0 days.

(21) Appl. No.: 09/365,765

(22) Filed: Aug. 3, 1999

(51) Int. Cl.[7] ..... A63B 26/00
(52) U.S. Cl. ..... 482/140; 482/142; 482/72
(58) Field of Search ..... 482/140, 142, 482/72, 95, 96

(56) References Cited

U.S. PATENT DOCUMENTS 4,796,881 * 1/1989 Watterson ..... 272/72
5,527,250 * 6/1996 Chen ..... 482/96
5,702,334 * 12/1997 Lee ..... 482/140
5,743,832 * 4/1998 Sands et al. ..... 482/52
5,769,766 * 6/1998 Huang ..... 482/140
5,827,158 * 10/1998 Drecksel ..... 482/96

* cited by examiner

*Primary Examiner*—Jerome W. Donnelly
*Assistant Examiner*—Lori Baker Amerson
(74) *Attorney, Agent, or Firm*—Bacon & Thomas, PLLC

(57) ABSTRACT

A complex exerciser structure including a base seat, a back lever, a pull lever and two support levers. The base seat includes a U-shaped lever and two seat levers fixed at two ends thereof. The vertically opposite ends of the U-shaped lever are respectively fixed with two support beams. A roller is inserted on each support beam for supporting the back lever and pull lever. One end of the U-shaped lever is connected with a support lever. The other end of the support lever is connected with the back lever and the pull lever. A grip and a back pad are fixedly disposed on the back lever. An upright support stem and a seat pad are fixedly disposed on the pull lever. Step rods fitted with soft sleeves are disposed on the support stem. The complex exerciser provides versatile exercising effects for a user.

5 Claims, 11 Drawing Sheets

COMPLEX EXERCISER STRUCTURE

BACKGROUND OF THE INVENTION

The present invention relates to a complex exerciser structure, and more particularly to a versatile exerciser which is able to train the muscles of various parts of human body. The exerciser can be freely changeably assembled to meet the requirements of different users.

There are various conventional exercisers. Most of these exercisers are designed for exercising and training the muscle of a specific portion of human body. For example, there are exercisers for training the back muscle, abdomen muscle, arm muscle, leg muscle, etc. FIGS. 10 and 11 show a conventional exerciser having an I-shaped base frame 50, a support beam 51 and a seat pad 52 locked on the support beam 51. One end of the support beam 51 is fixedly disposed with an upright stem 53 through which step rods 54 fitted with soft sleeves are passed. The other end of the support beam 51 is connected with a retaining beam 55 on which a back pad 56 is fixedly mounted. An end of the back pad 56 is disposed with two inclinedly extending handles 58 parallel to each other. The support beam 51 is connected with the retaining beam 55 via two parallel circular rods 57, whereby the retaining beam 55 is movable relative to the support beam 51. The above exerciser is able to exercise the muscle of a specific part of the user's body. However, such exerciser has only single function without other additional exercising effect. Therefore, in the case that the user needs to exercise the muscle of other parts of his/her body, he/she must purchase various exercises with different functions to achieve versatile exercising effects. This is not economical. Also, it will be inconvenient for the user to store various kinds of exercisers which will inevitably occupy much room.

SUMMARY OF THE INVENTION

It is therefore a primary object of the present invention to provide a complex exerciser structure in which the back lever and the pull lever can be independently or relatively operated to provide versatile exercising effect for various parts of human body.

The present invention can be best understood through the following description and accompanying drawings wherein:

DETAILED DESCRIPTION OF THE PREFERRED EMBODIMENTS

Figure 1:
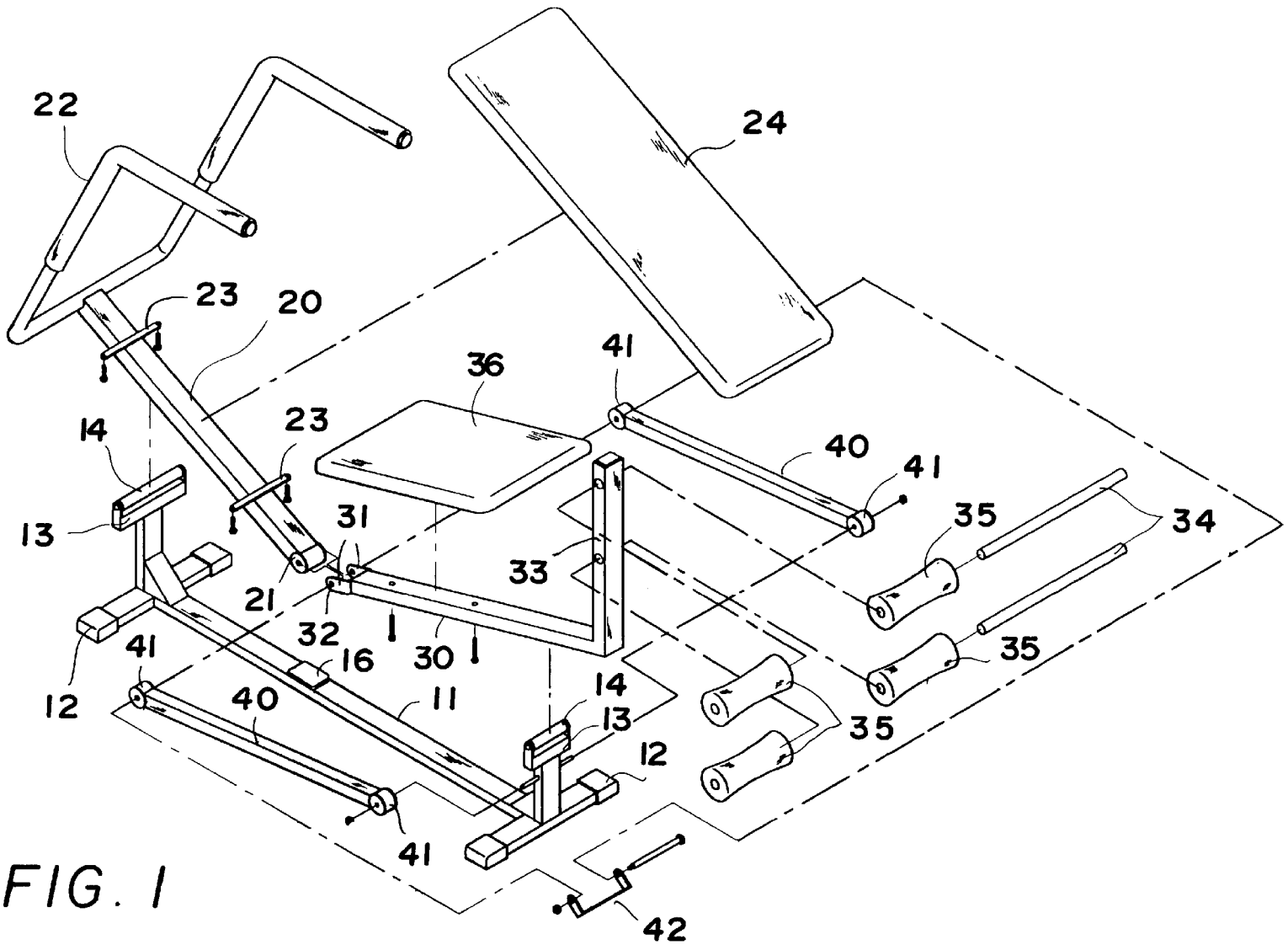
FIG. 1 is a perspective exploded view of a first embodiment of the present invention.

Please refer to FIG. 1. The complex exerciser of the present invention includes a base seat 10, a back lever 20, a pull lever 30 and two support levers 40.

The base seat 10 includes a U-shaped lever 11 and two seat levers 12 fixed at two ends thereof. The vertically opposite ends of the U-shaped lever 11 are respectively fixed with two support beams 13. A roller is inserted on each support beam 13. A pivot rod 15 is fixed on one of the vertical levers of the U-shaped lever 11. A middle section of the U-shaped lever 11 is disposed with a protective pad 16.

One end of the back lever 20 is formed as a hollow cylindrical body 21. The other end thereof is fixed with grip rods 22. Two parallel rods 23 are fixed on the face of the back lever 20 for locating the back pad 24.

One end of the pull lever 30 is disposed with two opposite lugs 31 each having a through hole 32. The other end thereof is fixed with an upright stem 33 through which parallel step rods 34 are passed. Two ends of each step rod 34 are fitted with soft sleeves 35. A seat pad 36 is fixed on the face of the pull lever 30.

The two support levers 40 are parallel to each other. Each end of the support lever 40 is disposed with a hollow cylindrical body 41.

Figure 2:
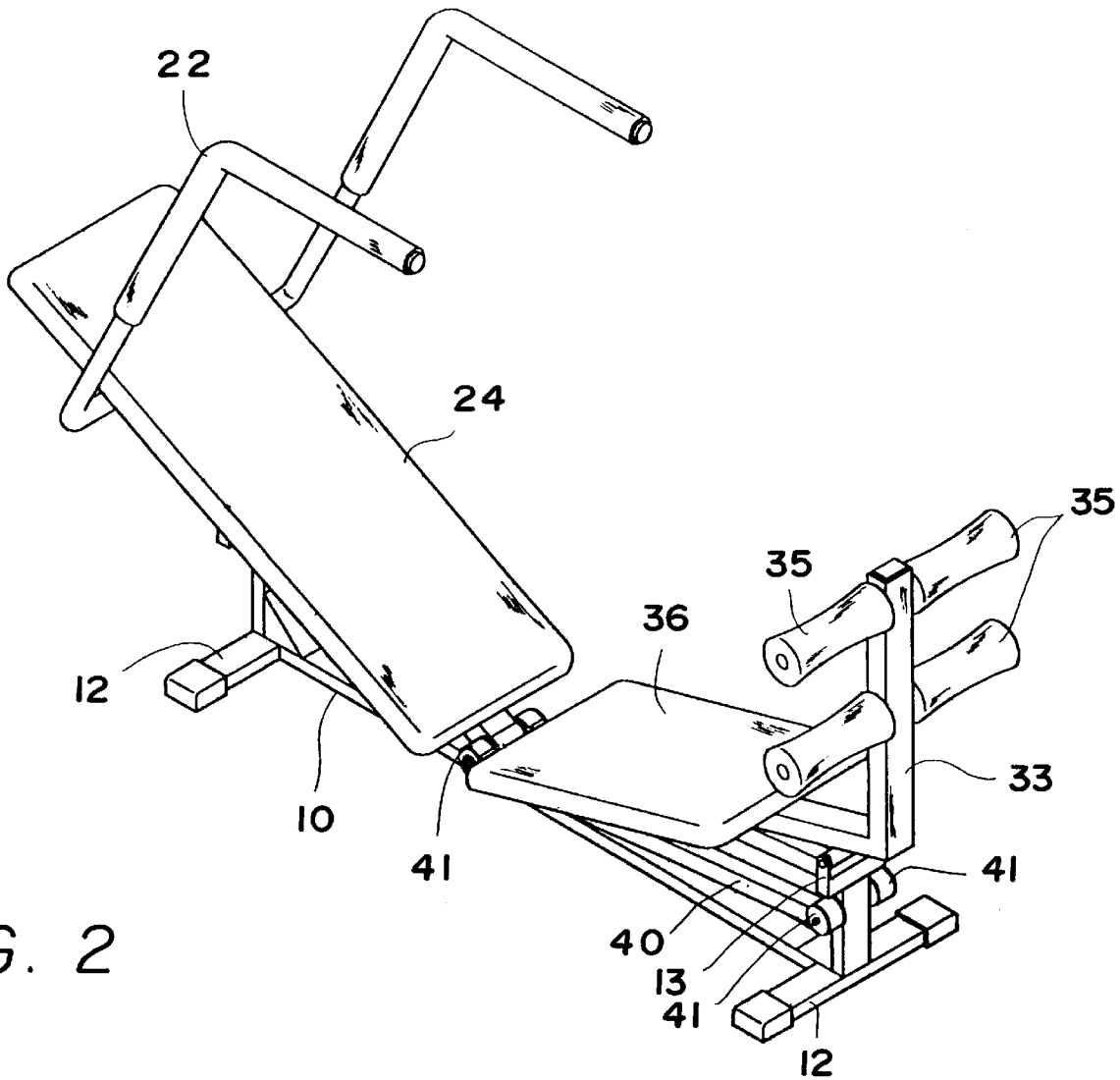
FIG. 2 is a perspective assembled view of the first embodiment of the present invention.

Please refer to FIG. 2. When assembled, the same ends of two support levers 40 are respectively fitted with the pivot rod 15 and tightened by nuts. Then the back lever 20 and the pull lever 30 are inclinedly placed on the base seat 10 with the hollow cylindrical body 21 at one end of the back lever 20 fitted with the lugs 31 at one end of the pull lever 30. Then the two support levers 40 are parallelly disposed on outer sides of the pull lever 30. The hollow cylindrical body 21, lugs 31 and the hollow cylindrical body 41 of the support levers 40 are coaxially positioned and clasped by a clasp 42 through which an insertion pin is passed for locating. The assembly is placed on the protective pad 16 of the U-shaped lever 11 to form a complete complex exerciser.

Figure 3:
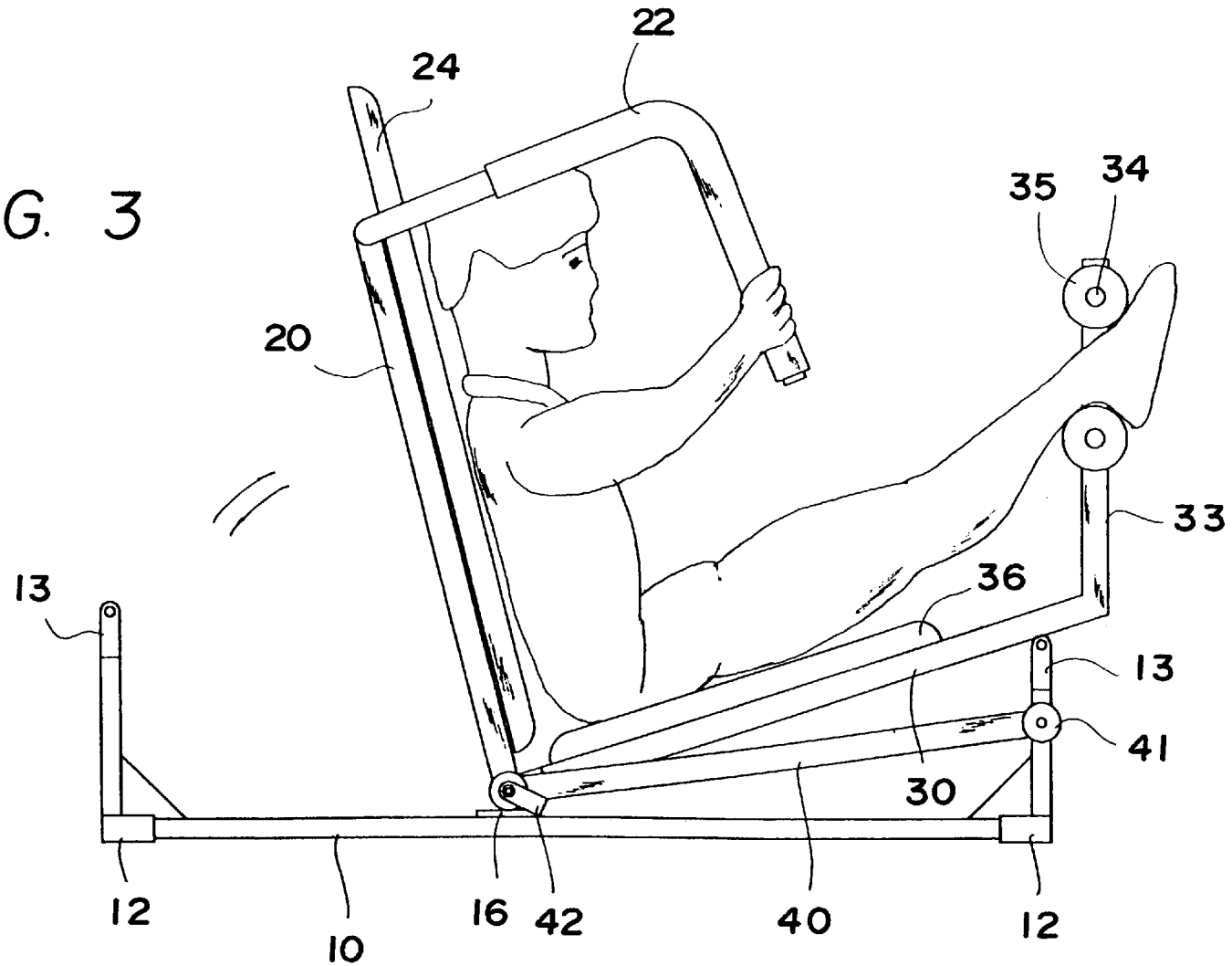
FIG. 3 shows the operation of the present invention in one state.
Figure 4:
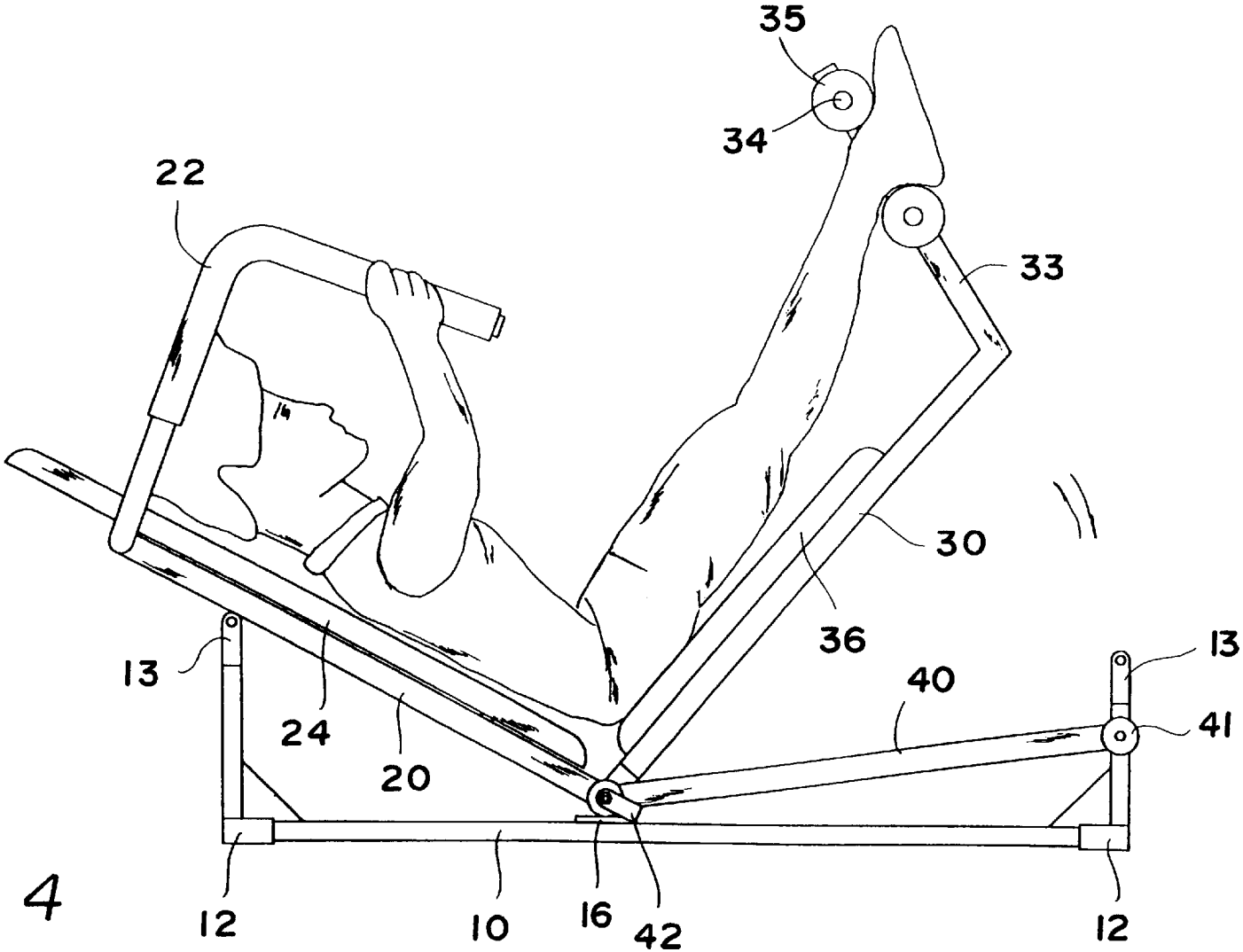
FIG. 4 shows the operation of the present invention in another state.
Figure 5:
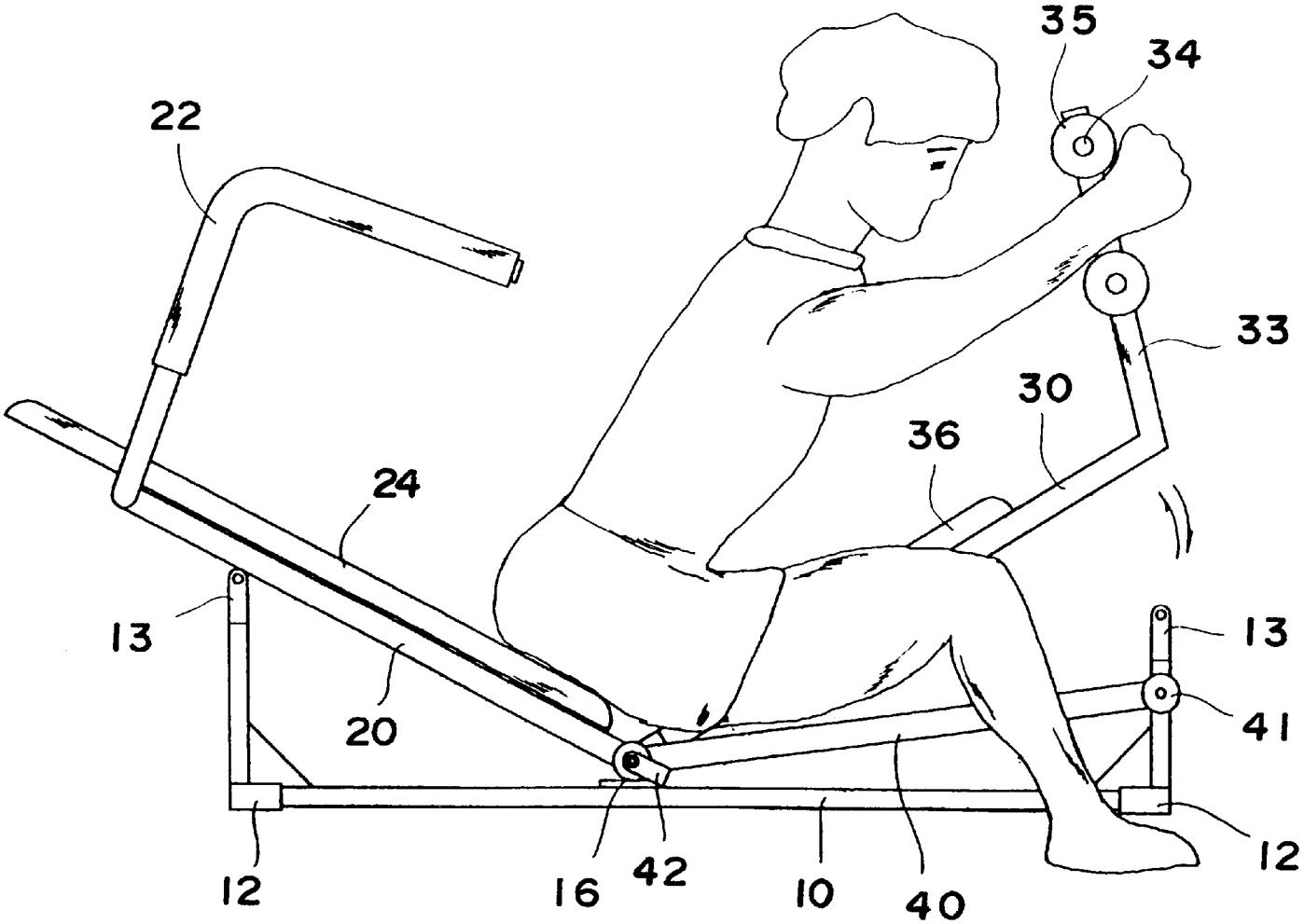
FIG. 5 shows the operation of the present invention in still another state.
Figure 6:
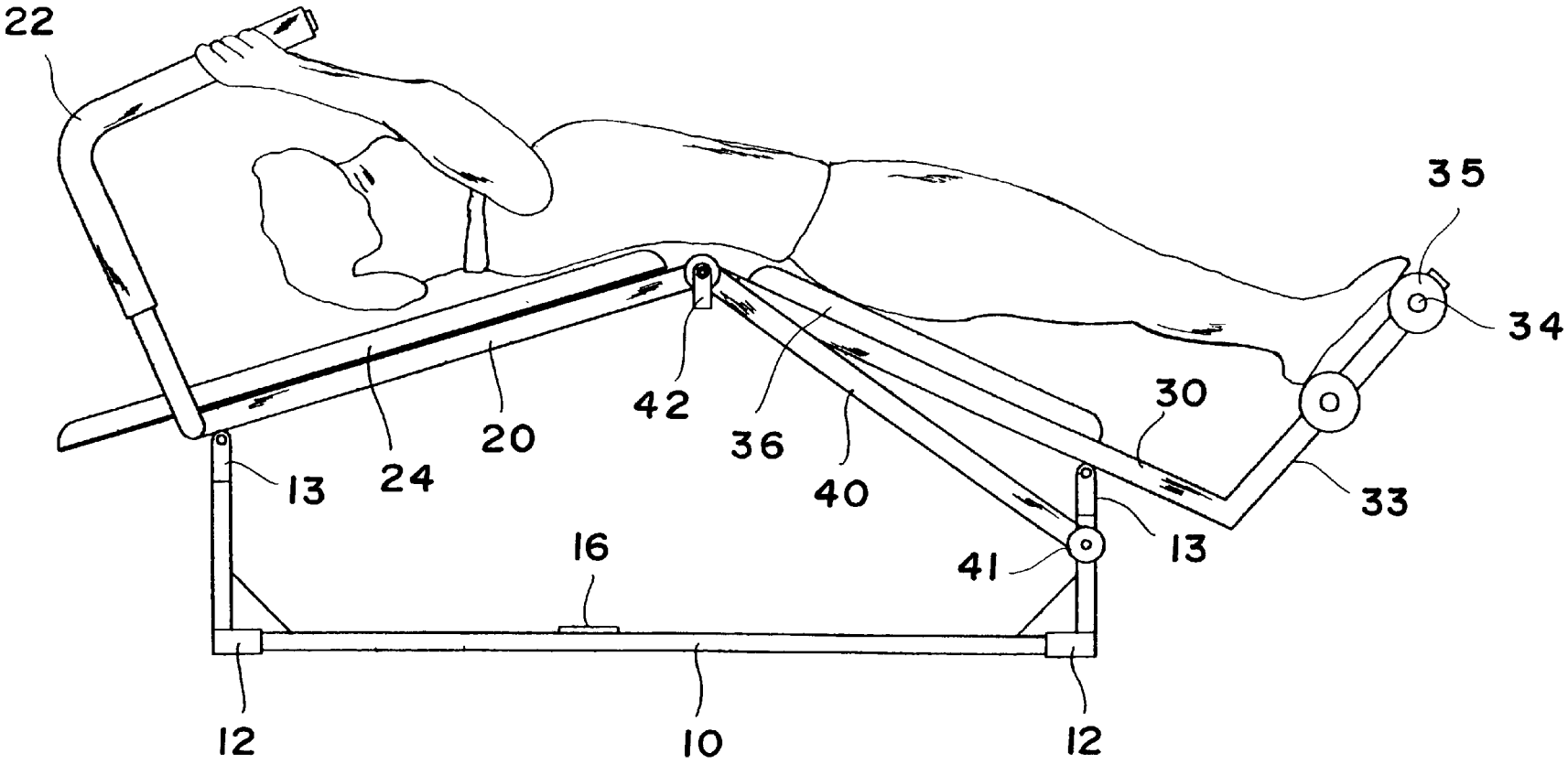
FIG. 6 shows the operation of the present invention in still another state.

Please refer to FIGS. 3 to 6 which show the use of the present invention in different aspects. Referring to FIG. 3, when the user wishes to train the muscle of waist, the lower half body sits on the seat pad 36, while the upper half body leans against the back pad 24 with the feet hooking the soft sleeves 35. At this time, the user holds the grip rods 22 with hands to force downward so as to lift the upper half body. The operation is repeated so as to train the muscle of the waist or the back. As shown in FIG. 4, inherently, the user's feet can force to pull up the pull lever 30. The operation is repeated to train the muscle of the legs. As shown in FIG. 5, when it is desired to train the muscle of the arms, the user rides on the back pad 24 and holds the soft sleeves 35 to force. The operation is repeated. As shown in FIG. 6, the user sits/lies on the seat pad 36 and back pad 24 and holds the grip rods 22 with hands with feet leant against the soft sleeves 35. At this time, the user's hands and feet simultaneously force outward so as to lift the connection between the back lever 20 and the pull levers 30 to form an arch shape. This helps in stretching of the entire body. The rollers 14 are disposed at two ends of the U-shaped lever 11, whereby when lifting the back lever 20 and the pull levers 30, the rollers 14 serve to reduce the frictional resistance and save strength.

Figure 7:
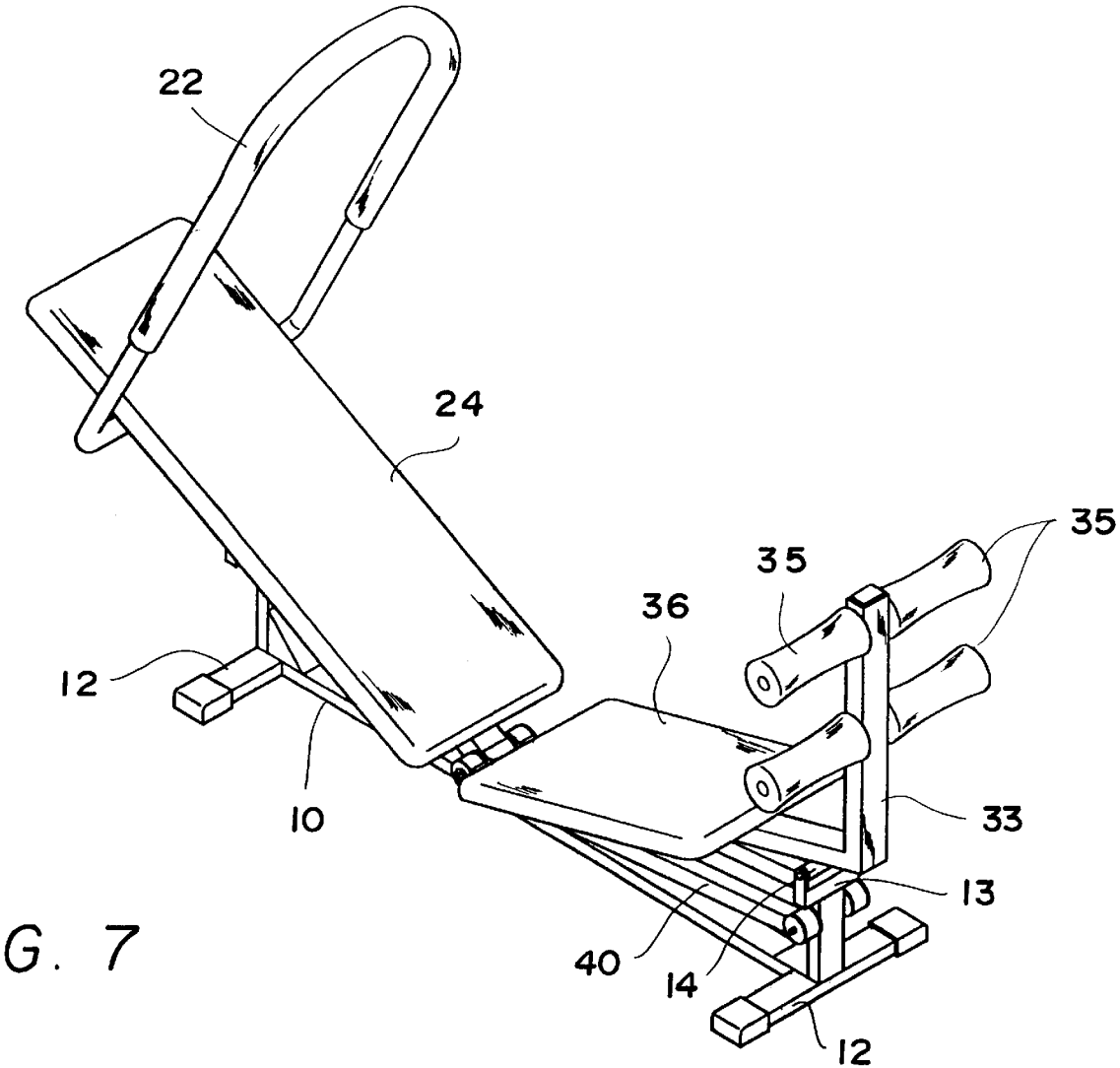
FIG. 7 is a perspective assembled view of a second embodiment of the present invention.
Figure 8:
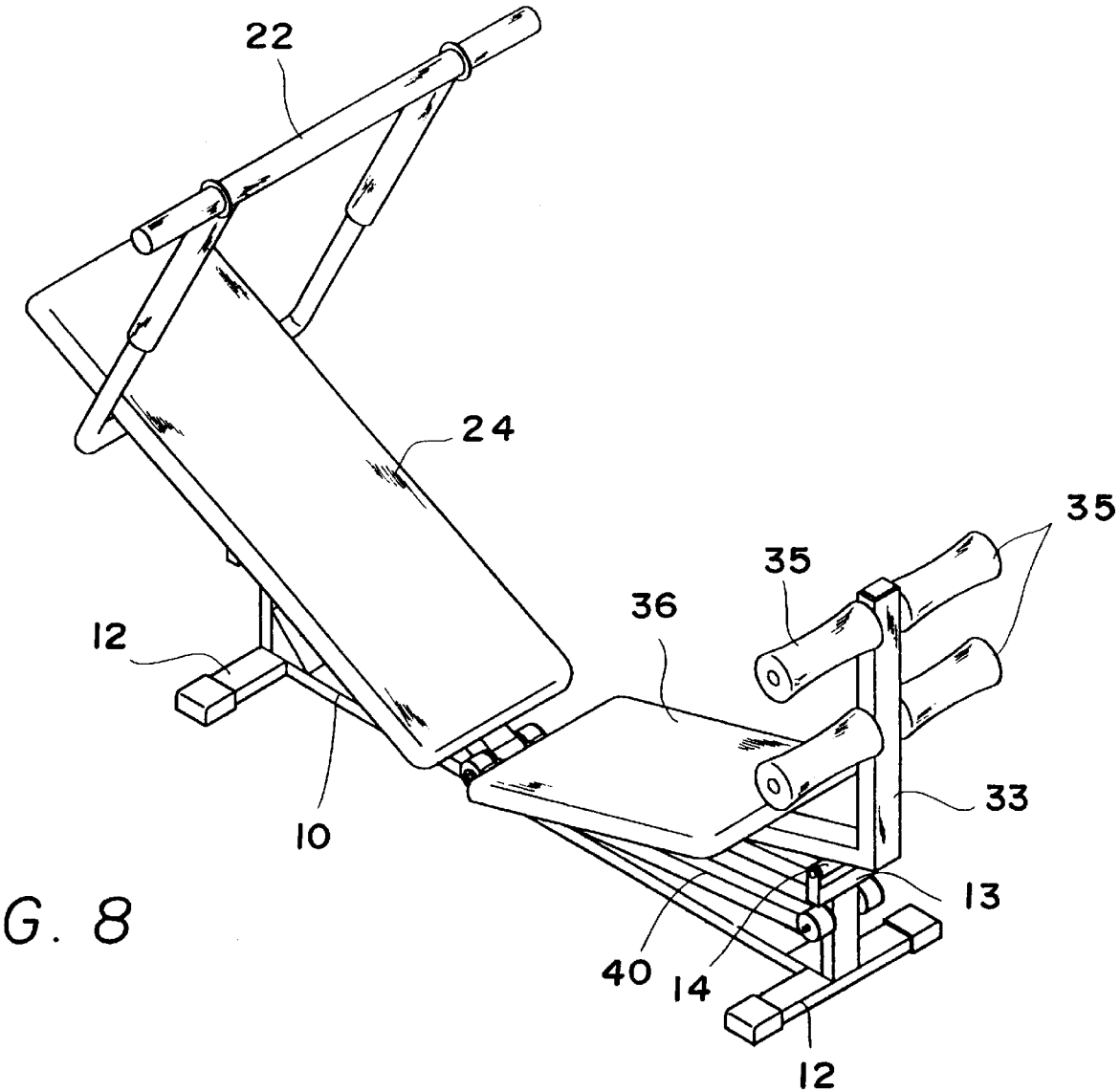
FIG. 8 is a perspective assembled view of a third embodiment of the present invention.

FIGS. 7 and 8 show other embodiments of the present invention. In order to achieve a more distinguishable pattern and further meet the requirement of human body engineering. The grip rods 22 are designed with different shape. As shown in FIG. 7, the grip rods 22 upward extend from two sides of bottom section of the back lever 20 and meet each other to form a ring pattern. As shown in FIG. 8, the grip rods 22 upward parallelly extend from two sides of the back lever 20. The top ends of the grip rods 22 are interconnected by a transverse beam to form a T-pattern.

Figure 9:
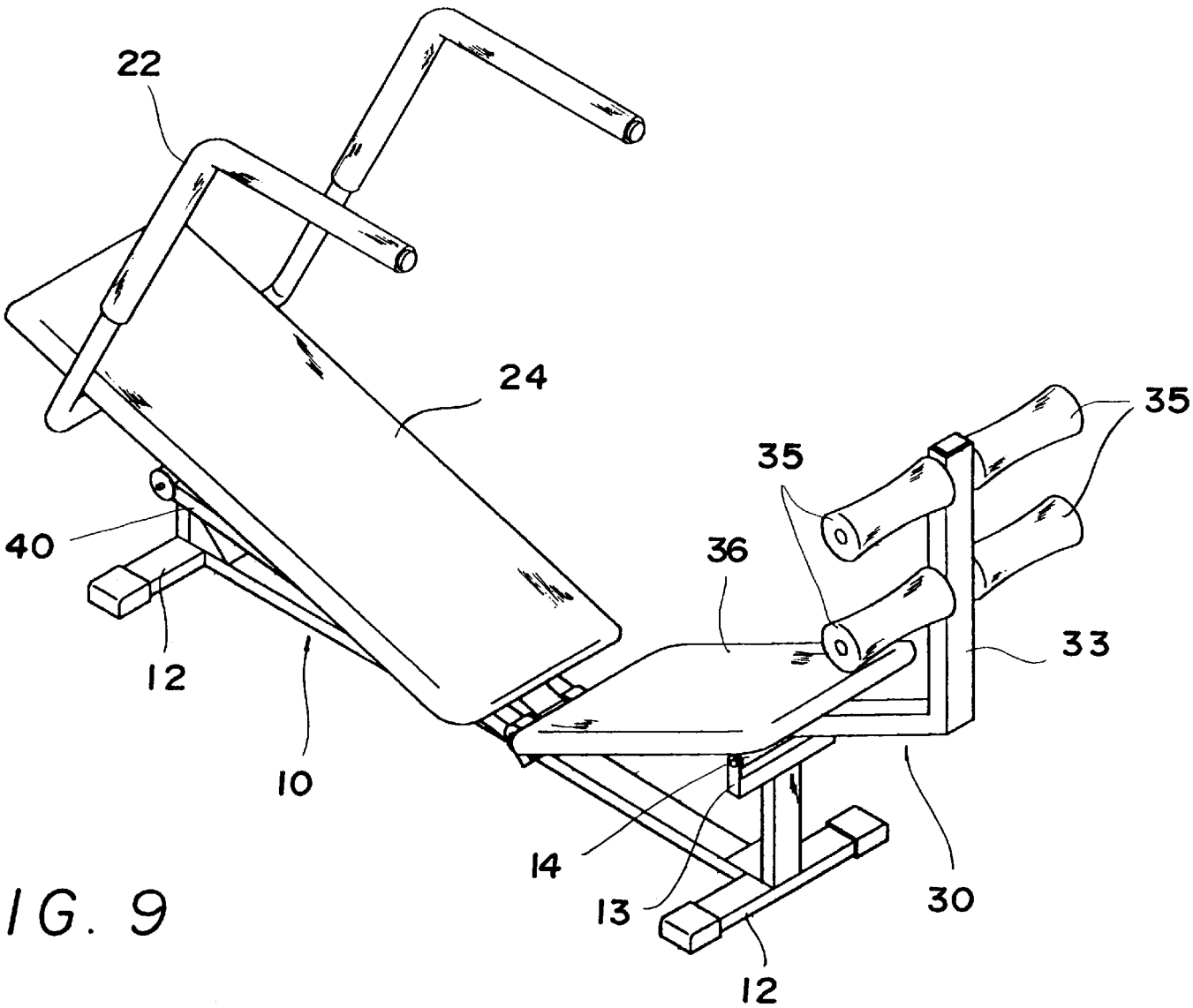
FIG. 9 is a perspective assembled view of a fourth embodiment of the present invention.
Figure 10:
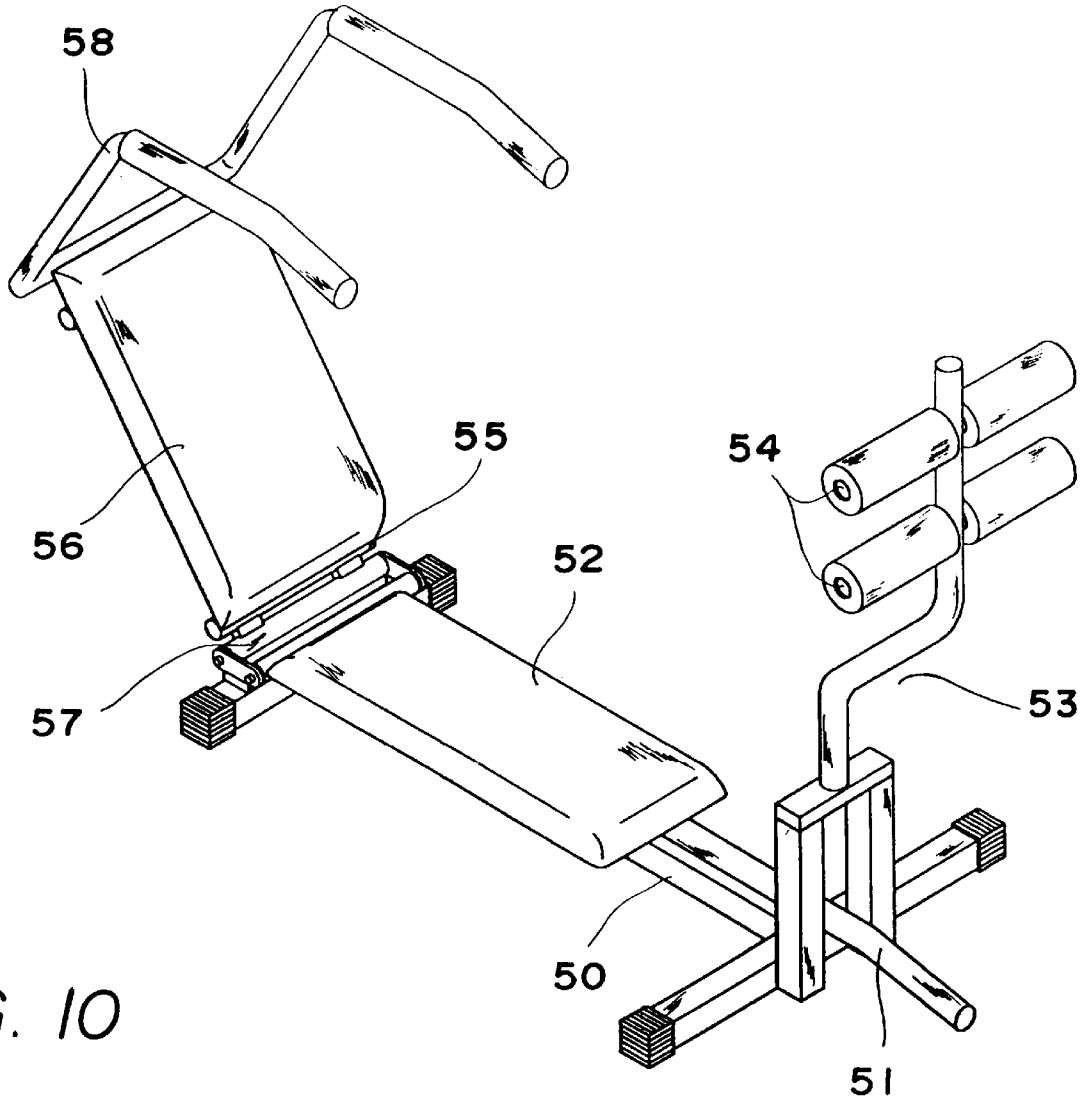
FIG. 10 is a perspective assembled view of a conventional exerciser.
Figure 11:
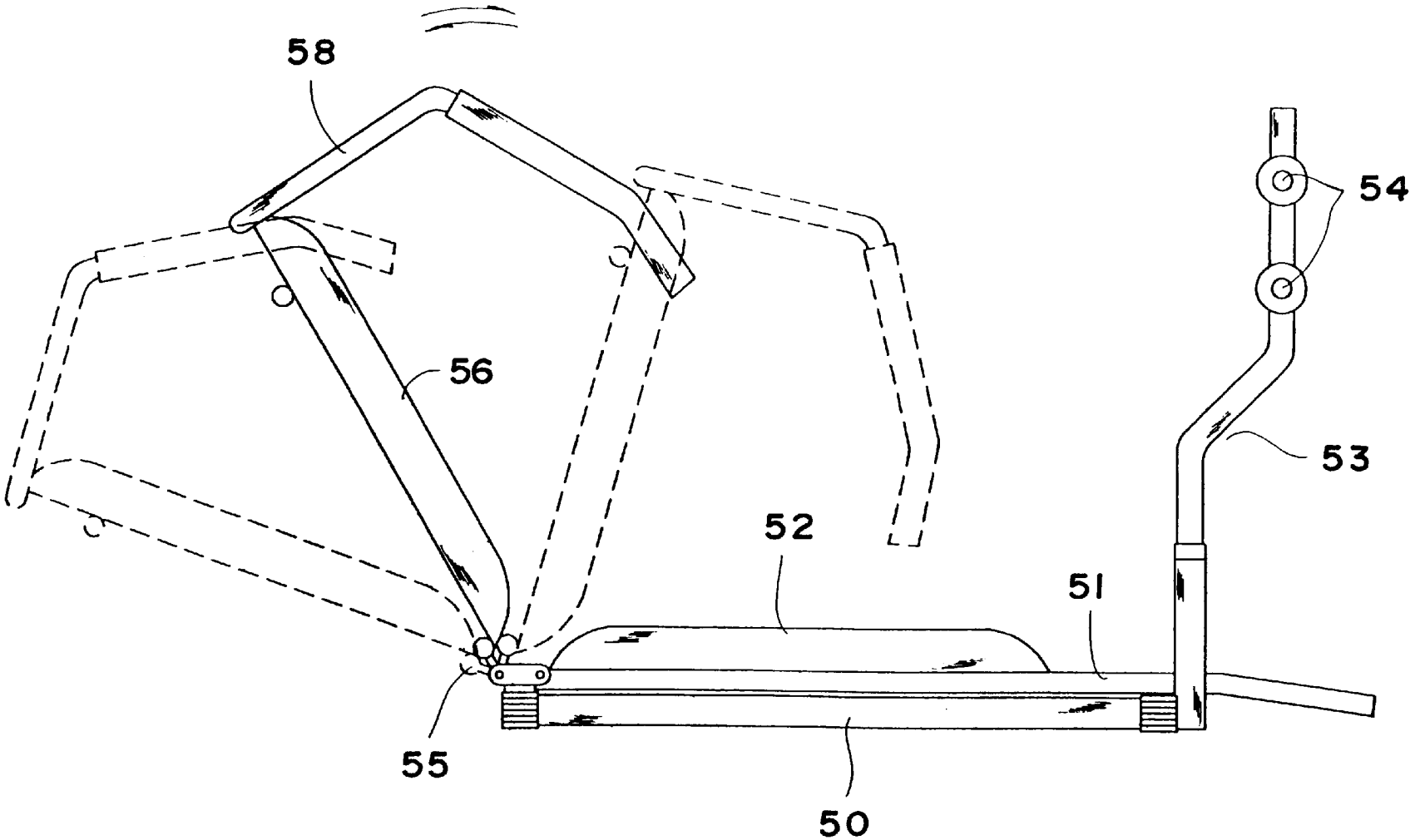
FIG. 11 shows the operation of the conventional exerciser.

In addition, the present invention can be freely versatile assembled. As shown in FIG. 9, the back lever 20 and the pull levers 30 can be exchanged in position. In addition, the connecting ends (hollow cylindrical bodies and lugs) of the back lever 20 and the pull levers 30 can be freely modified in manufacturing. The connecting ends between the back lever 20 and the pull levers 30 are simply disposed on the U-shaped lever 11 and the rollers 14 fixed at the ends of the U-shaped lever 11 serve as a fulcrum to form an open type. When the user trains his/her waist muscle (the gravity center falls onto the pull levers) or trains leg or arm muscle (the gravity center falls onto the back lever), by means of the supporting of the support levers 40, a reliable and safety effect can be achieved. In addition, in order to increase the structural strength of the entire exerciser, the number of the support levers 40 can be adjustably increased to meet the requirement of different users with different body configuration.

The above embodiments are only used to illustrate the present invention, not intended to limit the scope thereof. Many modifications of the above embodiments can be made without departing from the spirit of the present invention.

What is claimed is:

1. A complex exerciser structure comprising:

a base seat including a U-shaped lever and two seat levers fixed at two ends thereof, the vertically opposite ends of the U-shaped lever being respectively fixed with two support beams, a roller being inserted on each support beam, a pivot rod being fixed on one of the vertical levers of the U-shaped lever;

a back lever one end of which is formed as a hollow cylindrical body, the other end thereof being fixed with grip rods, two parallel rods being fixed on the face of the back lever for locating the back pad;

a pull lever one end of which is disposed with two opposite lugs each having a through hole, the other end thereof being fixed with an upright stem through which parallel step rods are passed, two ends of each step rod being fitted with soft sleeves, a seat pad being fixed on the face of the pull lever; and two support levers which are parallel to each other, each end of the support lever being disposed with a hollow cylindrical body.

2. A complex exerciser as claimed in claim 1, wherein a protective pad is disposed on a middle section of the U-shaped lever, a connection between the back lever and the pull lever being rested on the protective pad for avoiding damage of the base seat.

3. A complex exerciser as claimed in claim 1, wherein the grip rods upward extend from two sides of the back lever and meet each other at the ends to form a ring pattern and are interconnected by a transverse beam at the ends.

4. A complex exerciser as claimed in claim 1, wherein the hollow cylindrical body at one end of the back lever is formed as a lug, while the lug at one end of the pull lever is formed as a hollow cylindrical body.

5. A complex exerciser as claimed in claim 1, wherein the number of the support levers is adjustable.

* * * * *